US006615722B2

(12) United States Patent
Alberstadt et al.

(10) Patent No.: US 6,615,722 B2
(45) Date of Patent: Sep. 9, 2003

(54) REPLACEABLE CYLINDER ELEMENT INCLUDING CYLINDRICAL SLEEVE AND END MEMBERS HAVING COMPLEMENTARY CENTERING FACES

(75) Inventors: Wolfgang Heinrich Alberstadt, Stockstadt am Rhein (DE); Christian Compera, Schoenau (DE); Andreas Dickhoff, Kirchheim/Teck (DE); Karlheinz Groeninger, Maintal (DE); Gregory Kowalski, Victor, NY (US); James Shifley, Spencerport, NY (US)

(73) Assignee: Nex Press Solutions LLC, Rochester, NY (US)

( * ) Notice: Subject to any disclaimer, the term of this patent is extended or adjusted under 35 U.S.C. 154(b) by 0 days.

(21) Appl. No.: 09/858,429

(22) Filed: May 16, 2001

(65) Prior Publication Data

US 2001/0042476 A1 Nov. 22, 2001

Related U.S. Application Data

(60) Provisional application No. 60/204,884, filed on May 17, 2000.

(51) Int. Cl.[7] ..... B41F 13/20; G03G 15/00

(52) U.S. Cl. ..... 101/375; 101/401.1; 101/479; 101/217; 399/26; 399/116; 399/117; 399/159; 492/47; 492/57

(58) Field of Search ..... 101/216, 217, 101/375, 376, 401.1, 479; 399/26, 116, 117, 159; 492/47, 57

(56) References Cited

U.S. PATENT DOCUMENTS

| | | | | | |
|---|---|---|---|---|---|
| 2,587,606 | A | * | 3/1952 | Dungler | 101/248 |
| 4,119,032 | A | | 10/1978 | Hollis | 101/216 |
| 4,527,883 | A | * | 7/1985 | Kamiyama | 399/117 |
| 4,823,160 | A | * | 4/1989 | Ikuta et al. | 399/117 |
| 5,151,737 | A | * | 9/1992 | Johnson et al. | 399/117 |
| 5,215,013 | A | | 6/1993 | Vrotacoe et al. | 101/217 |
| 5,490,458 | A | * | 2/1996 | Stuart | 101/375 |
| 5,649,267 | A | | 7/1997 | Aerens et al. | 399/159 |
| 6,246,851 | B1 | * | 6/2001 | Tietze et al. | 399/159 |
| 6,382,837 | B1 | * | 5/2002 | Olbrich et al. | 384/278 |

FOREIGN PATENT DOCUMENTS

| | | | |
|---|---|---|---|
| DE | 37 05 477 C1 | 5/1988 | B41F/27/10 |
| DE | 40 36 387 A1 | 5/1992 | B41F/13/20 |
| DE | 40 36 388 A1 | 5/1992 | B41F/13/20 |
| DE | 40 36 390 A1 | 5/1992 | B41F/13/20 |
| DE | 40 36 391 A1 | 5/1992 | B41F/13/20 |
| EP | 0 575 739 B2 | 3/1999 | B41F/13/20 |

* cited by examiner

*Primary Examiner*—Leslie J. Evanisko
(74) *Attorney, Agent, or Firm*—Lawrence P. Kessler

(57) ABSTRACT

A cylinder with a functional layer (23) and with a supporting body (1), which passes through the cylinder. On the supporting body (1), a sleeve that accommodates the functional layer (23) is supported at ends (2, 5). The supporting body (1) is for its part accommodated on supporting elements (10, 11, 13) provided on the frame side. The cylinder sleeve (3) that accommodates the functional layer (23) can be centered in relation to the axis of rotation (8) by centering faces (6, 7) formed at the ends (2, 5). One end of the cylinder can be exposed at the supporting element (13).

5 Claims, 2 Drawing Sheets

REPLACEABLE CYLINDER ELEMENT INCLUDING CYLINDRICAL SLEEVE AND END MEMBERS HAVING COMPLEMENTARY CENTERING FACES

This application is a provisional of No. 60/204,884 filed May 17, 2000.

FIELD OF THE INVENTION

The invention relates to replaceable cylinder elements on electrographic printing units used to print web or sheet material.

BACKGROUND OF THE INVENTION

DE 37 05 477 C1 has disclosed a holding device for fitting a sleeve to a cylinder. In order to fit a sleeve through an opening in a printing-unit side wall, on the outside of the other printing-unit side wall of the cylinder, on the lengthened shaft journals of the cylinder, an eccentrically mounted auxiliary shaft mounted above the cylinder and arranged transversely is positioned in a gearbox. By setting nuts, the auxiliary shaft and thus the shaft journal of the cylinder can be adjusted and fixed horizontally. In this arrangement, a sleeve is pushed laterally through an opening in the printing-unit side wall onto the solid printing-unit cylinder of a printing unit in a rotary printing machine.

DE 40 36 387 A1 and DE 40 36 388 A1 each reveal mountings for printing-unit cylinders in rotary printing machines. The first laid-open specification discloses a mounting for a printing-unit cylinder in a web-fed rotary printing machine, having a cover which can be interchanged and, for this purpose, can be drawn axially off the cylinder. An auxiliary device which supports the cylinder on one side when the cover is being changed is intended to lock said cylinder by enclosing it but not to impair and not to contact it during printing operation. For this purpose, according to DE 40 36 387 A1, outside and/or inside the machine side wall which continues to bear the journal when the cover is being changed, a roller with a concave outer face which supports the cylinder can be brought into contact with the journal, being mounted on a lever that is mounted in the machine frame and can be pivoted over in the longitudinal direction of the journal.

DE 40 36 388 A1, constitutes an alternative solution, outside and/or inside the machine side wall that bears the journal of the cylinder, it being possible for a lever which supports the cylinder to be brought into contact in each case with the journal, and for said lever to be rotatably mounted in the frame, has an eccentric which is located beside the journal and perpendicular to the supporting face and, by means of a four-bar linkage, is connected to a further eccentric mounted in the frame on the other side of the journal. This solution, which entails a quite complicated mechanism, relates to printing units of web-fed rotary printing machines, with which solid cylinders are supported in the printing unit during a sleeve change.

DE 40 36 390 A1 and DE 40 36 391 A1 each relate to mountings for printing-unit cylinders in web-fed rotary printing machines.

DE 40 36 390 A1 reveals an auxiliary device which supports the cylinder of a web-fed rotary printing machine on one side when a cylinder cover is being changed, and locks the cylinder but does not contact it during printing operation. For this purpose, a centering piece which is mounted centrally in relation to the journal of the cylinder, which is mounted in the machine side wall and projects from the latter, is arranged in the machine frame or can be pushed into the journal.

DE 40 36 391 A1 likewise relates to a holding device for a printing-unit cylinder during the time at which a cover is being changed on the latter. According to the solution from DE 40 36 391 A1, outside and/or inside the machine side wall which bears the journal of the cylinder, in each case a carriage which is arranged such that it can be displaced in the frame, supports the journal and partially encloses it in a recess, can be brought into contact with the journal by an eccentric.

U.S. Pat. No. 4,119,032 likewise discloses a holding device for a cylinder which has its cover changed when it is installed in the printing unit of a printing machine. For this purpose, one journal of the complete cylinder, which is mounted in the side walls of the printing machine, can be exposed by removing part of the side wall, while the other cylinder journal provided on the drive side is enclosed by a yoke, so that the cylinder remaining in the printing unit is protected against tilting, and the cover of the cylinder can be replaced.

EP 0 575 739 B2 relates to a device for supporting a cylinder in a rotary printing machine having a frame of side walls arranged spaced apart from each other. Provided therein is a printing cylinder having a supporting element for supporting the ends of the printing cylinder in the side walls. The supporting element can be removed from one end of the printing cylinder, a counterweight mechanism being provided which has a rotary arm that can be adjusted in position and which, in a supporting position, exerts force on the other end of the printing cylinder, in order to support the latter in the frame when the supporting element is being removed. A hinged piece for moving the rotary arm into the position in which it supports the cylinder, and for holding the rotary arm in this position against the weight of the printing cylinder, has an end position for its mobility for adjusting the rotary arm. By the end position, a surprising or sudden pressure drop in the holding system can be prevented, and the cylinder can be held in its position in the printing unit of the rotary system even in the event of a pressure drop in the hydraulic system of the holding apparatus.

U.S. Pat. No. 5,215,013 relates to a cylinder which is accommodated in a printing unit of a web-processing rotary printing machine and onto which a sleeve-like transfer sleeve can be pushed. For this purpose, before being pushed onto the cover of the cylinder, which is located in the printing machine and supported on one side, the sleeve is widened by pressurized air, so that the sleeve can be pushed laterally onto the cover. The air flowing out laterally from the air cushion during this process causes high-frequency noise, which is damped by a damping ring let into the sleeve to be pushed on.

U.S. Pat. No. 5,649,267 discloses a method of arranging a drum, it being possible for the drum to be used in a printing unit. A toner image can be arranged on the circumferential surface of the drum, which is used as an endless rotating surface. The drum includes a hollow cylinder with an opening at each end and a surface onto which the toner image can be applied. A supporting face, which contains an opening in its interior, is cooled down before it is inserted into the drum surface at its ends, and is thus shrunk into the open ends of the outer face of the drum. When the previously cooled, disk-like elements are heated, these expand and thus produce a press fit between the outer face and the ends. In addition, openings, in which a carrier supporting the drum can be accommodated, are provided in the ends. In the case of the solution according to U.S. Pat. No. 5,649,267 there is the disadvantage that, in order to renew the functional layer on the outer face of the cylinder, the complete arrangement has to be replaced, since the ends of the drum arrangement are in each case shrunk into the arrangement forming the outer face. Cooling within the machine in order to break down the ends around the drum arrangement in the machine, is extremely complex and cumbersome.

In the case of cylinder arrangements with photoelectric functional surfaces, wear which sets in, for example as the result of the removal of particles from the surface, necessarily occurs over the surface life, depending on the stress on the photoelectric layer, and constitutes a technical problem.

SUMMARY OF THE INVENTION

In view of the solutions disclosed from the prior art, which primarily relate to supporting solid cylinders on one side in web-fed rotary printing machines, and the solution disclosed by U.S. Pat. No. 5,649,267, the invention is based on the object of simplifying the replacement of a functional layer, for example a photoelectric layer, on a cylinder of a printing unit, and of carrying out such replacement within the printing unit with extremely low outlay.

According to the invention, in the case of a cylinder with a functional layer and with a supporting body which passes through the cylinder and on which there are provided two ends which support a sleeve that accommodates the functional layer, the supporting body being supported in supporting elements on the frame side, the sleeve that accommodates the functional layer can be centered in relation to the axis of rotation by centering faces formed at the ends supporting said sleeve, it being possible for one end of the cylinder to be exposed at a supporting element. The advantages which are associated with the solution proposed according to the invention reside primarily in the fact that a cylinder arrangement is such that following the exposure of an opening in one side wall supporting the cylinder arrangement, it can be removed laterally from the printing unit. After one end with centering faces has been detached, from the supporting body, the worn outer surface can be replaced, for example, by a reworked or even a new photoelectric functional layer, it being possible for the ends that accommodate the centering faces and the supporting body that passes through the cylinder arrangement, together with all the rolling-contact bearings accommodated thereon, to be reused. The solution according to the invention is primarily associated with the economic advantage that the entire cylinder does not have to be replaced, since the centering faces form detachable connections between the ends and the cylinder sleeve that bears the functional surfaces in contrast to press fits which are formed by shrunk connections, which can be detached only with difficulty.

In a further refinement of the idea on which the invention is based, the ends which are accommodated on the supporting body, that is to say an axle/shaft, are provided with circumferential centering faces. The circumferential centering faces at the ends can have a specific geometry, it being possible for the cylinder sleeve that accommodates the functional layer to be provided at its ends with a chamfer which is complementary to the chamfer on the centering faces of the ends which accommodate the sleeve. In an implementation which is advantageous and particularly simple in production terms, the centering faces at the end faces can be formed as chamfers.

In an advantageous refinement of the idea on which the invention is based, one of the ends can be positioned on the supporting body in relation to the other end of the supporting body. By fixing the axial position of one end and an end which can be displaced in relative terms with respect to this fixedly positioned end, inaccuracies caused by production can be compensated for without difficulty, and in addition an eccentricity can be set by suitable selection of the centering faces. The relative adjustability of the positionable end in relation to the end which is accommodated in a stationary manner on the supporting body, permit both the rotation of the positionable end in the circumferential direction on the supporting body and its axial displaceability relative to the other end.

In an advantageous refinement of the idea on which the invention is based, the positionable end is provided with a clamping device. For this purpose, said clamping device can contain a pressure element which can be prestressed axially by a slotted nut and which, by the slotted nut, transmits the axial force acting on said pressure element, by radial deformation, onto a radially deformable sleeve which is accommodated between the relatively positionable end and the supporting body.

In one alternate embodiment, the positionable end on the supporting body can be configured as a sleeve-like element that engages over the supporting body and a bearing journal provided on the latter. The end configured as a sleeve-like element can in turn function as a bearing element for the supporting body. For this purpose, in a region of the sleeve-like end which is located closest to the frame wall, a bearing element can be provided on the outer circumference of this sleeve-like element, with which bearing element the supporting body can be mounted in the frame wall.

In order to expose one end of the cylinder arrangement according to the invention proposed, one end of the cylinder arrangement can be exposed by removing a fixing element that accommodates the bearing point of the cylinder arrangement from the frame side wall.

The solution according to the invention can preferably be used in a printing mechanism of a printing unit which is used for small editions with rapidly changing subjects, such as those printing units to whose cylinder outer surfaces toner images are applied, for example to photoelectric functional layers, which are subject to wear as a result of the principle.

BRIEF DESCRIPTION OF THE DRAWINGS

The invention will be explained in more detail below using the drawing, in which.

DETAILED DESCRIPTION OF THE INVENTION

Figure 1:
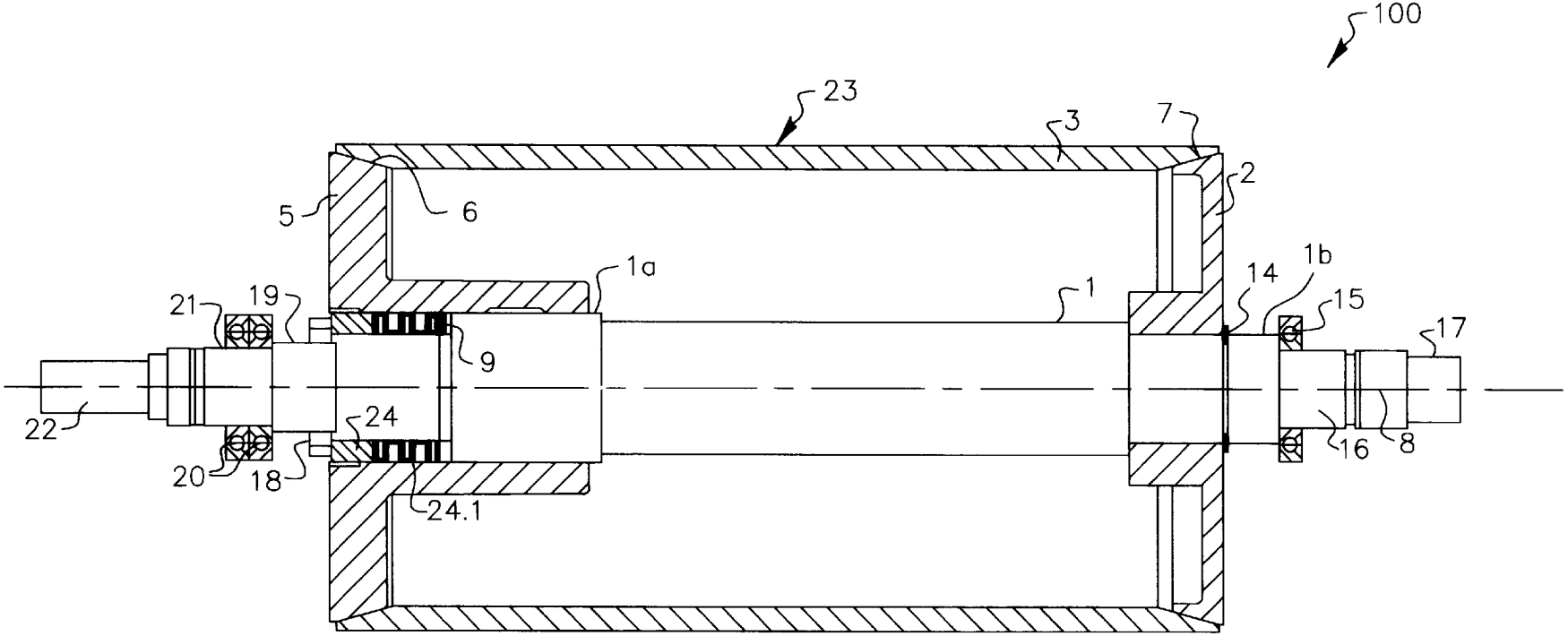
FIG. 1 shows a cylinder arrangement with a supporting body in the form of a shaft that accommodates ends, and a sleeve which is centered on the ends and accommodates the functional layer of the cylinder.

FIG. 1 reveals a cylinder arrangement 100 with a supporting body 1 accommodated at the ends and a sleeve 3 which is centered at the ends and accommodates the functional layer 23 of the cylinder arrangement. The cylinder arrangement 10 illustrated in FIG. 1 includes a supporting body 1 which passes through the cylinder cavity, and two ends 2 and 5 which are accommodated on seating faces 1*a*, 1*b* and are formed as centering flanges. On centering faces 6, 7, which are chamfers and, which are provided in the circumferential direction on the centering flanges 2, 5, there is accommodated a cylinder sleeve 3 (with complimentary chamfers), on whose upper side there is formed a functional layer 23 which, in the case of printing units operating electrographically, can be a photoelectric layer. During the printing process, this layer is subject to unavoidable wear and therefore has to be replaced. In order to implement this replacement simply and cost-effectively, the sleeve 3, whose outer face bears the functional layer 23, is accommodated with a force fit on the centering faces 6, 7 on the centering flanges 2 and 5, and can also be removed from the latter after the centering flange 5 has been mounted.

The centering flanges 2 and 5 are accommodated on the circumference of the supporting body 1. In the exemplary embodiment illustrated in FIG. 1, the centering flange 2 is secured by a securing ring 14 on a seating face 1*b* on the supporting body 1, and is supported with its hub on a collar of the supporting body 1 and is therefore fixed in the axial direction. By contrast, the centering flange 5 is secured on its seating face 1*a* via a slotted nut 18. The slotted nut 18 acts on a pressure element 24 of annular configuration and displaces the latter in the axial direction, according to the pitch of the thread 19 that cooperates with the slotted nut 18, beside the pair of bearings 20. The annular pressure element 24 acts on a sleeve 24.1 which can be deformed in the circumferential direction and expands radially and with which the centering flange 5 that can be removed from the circumference of the supporting body 1 is fixed on its seating face 1*a*. The clamping device 9 formed by the deformable sleeve 24.1 underneath the centering flange 5 permits the exact axial positioning of the centering flange 5 relative to the supporting body 1, so that the eccentricity and the circumferential position of the cylinder sleeve 3 with the functional layer 23 can be aligned relative to the axis of rotation 8 of the supporting body 1.

Illustrated beside the centering flange 2, which is fixed on the supporting body 1 in a stationary position, is a bearing which is accommodated on the bearing seat 16 of the journal 17 and which is identified by reference symbol 15.

Formed at the opposite end of the cylinder arrangement according to FIG. 1 is a bearing journal 22, which accommodates a pair of bearings 20 accommodated on a seating face 21. The pair of bearings 20 is supported on the outer end of the thread 19 on which the slotted nut 18 can be rotated which, for its part, prestresses the pressure element 24. By the circumferential position of the slotted nut 18 on the slotted-nut thread 19, the prestress on the deformable sleeve 24.1 under the centering flange 5 on the supporting body 1 can be preset.

Figure 2:
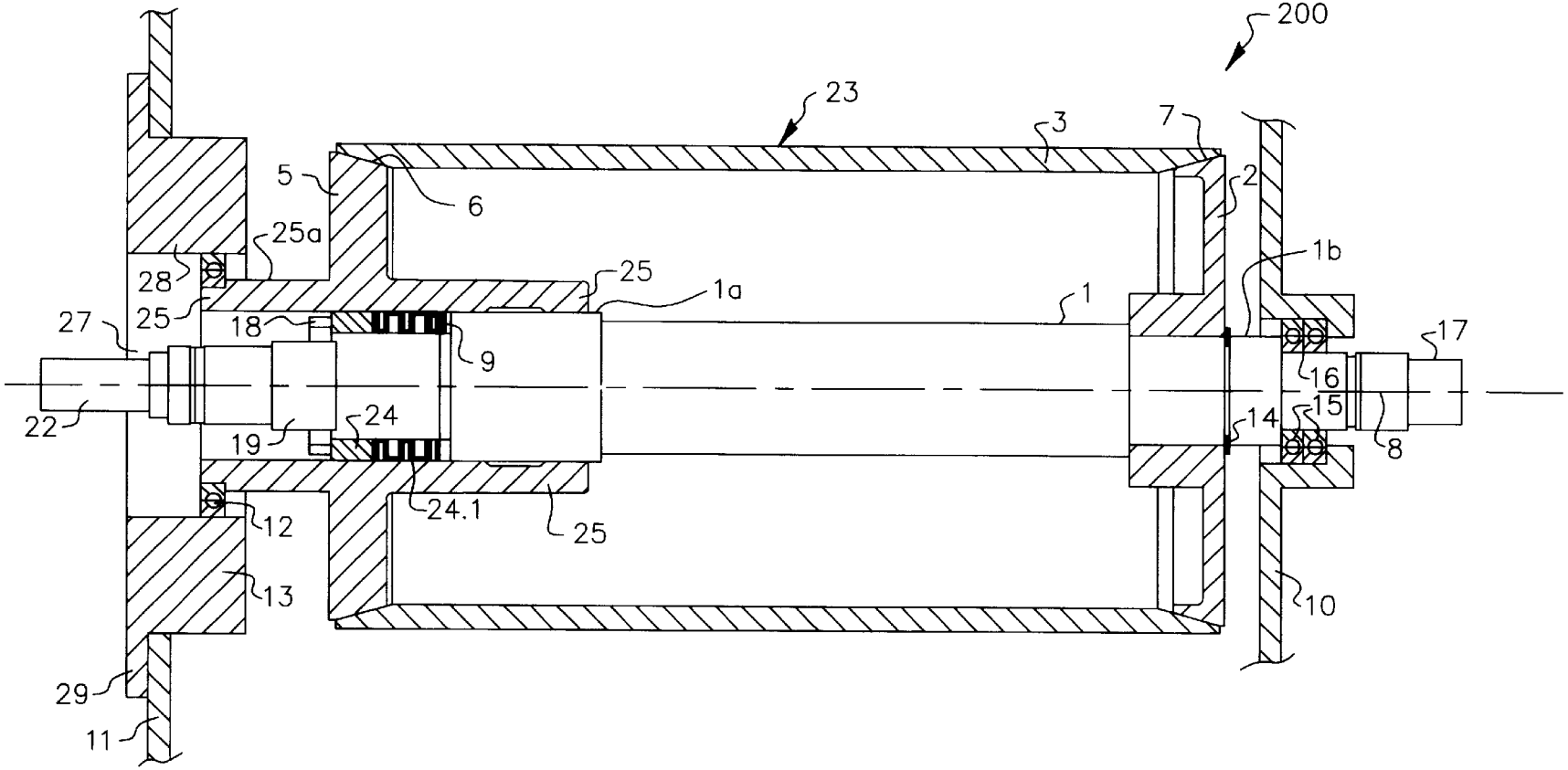
FIG. 2 shows the cylinder arrangement according to FIG. 1, mounted in side walls of a printing unit, it being possible for one end of the cylinder arrangement to be exposed.

The illustration according to FIG. 2 reveals a cylinder arrangement 200 according to FIG. 1 which is mounted in frame walls 10, 11 of the printing unit.

Formed on the centering flanges 2 and 5, which are accommodated on the circumference of the supporting body 1 either fixed axially or such that they can be positioned in relative terms, are the centering faces 6, 7, which are chamfers. The cylinder sleeve 3 that accommodates the functional layer 23 is fixed with a force fit but detachably on the centering faces 6, 7 of the centering flanges 2 and 5, which are preferably formed as chamfers by complementary chamfers on the sleeve ends. In the illustration according to FIG. 2, on the journal 17 of the cylinder arrangement there is formed a seating face 16, on which there is arranged a bearing 15, here a pair of bearings. This pair of bearings 15 is supported in a bearing opening in the frame part 10 of the printing unit. The centering flange 2 is secured in its axial position on the circumference of the supporting body 1 by a securing ring 14, so that an axial position in relation to the circumference of the supporting body 1 is fixed.

On the opposite journal 22 of the cylinder arrangement according to FIG. 2, in a manner similar to the illustration of FIG. 1, there is formed a thread 19, on which a slotted nut 18 is arranged such that it can be rotated and exerts an axial force on a pressure element 24 of clamping device 9. The axial force of the pressure element 24, applied by the slotted nut 18, is transmitted to a deformable sleeve 24.1, whose deformation in the radial direction ensures the clamping of the centering flange 5 which, in FIG. 2, has a sleeve-like portion 25 and which can therefore be positioned at its seating face 1*a* on the supporting body 1.

As opposed to the illustration in FIG. 1, the centering flange 5 is formed with a sleeve-like portion 25 which, in addition to a section that engages over the seating face 1*a* of the supporting body 1, also has a section 25*a* which engages over the slotted nut 18 and the thread 19. Accommodated at the end of this section 25*a* of the sleeve-like portion 25 is a rolling-contact bearing 12, which is supported on the wall 28 of a bore 27 in the fixing element 13. The fixing element 13 is for its part provided with a circumferential collar 29, with which it is supported on the frame part 11 of the printing unit and can be fixed in the frame part 11, for example via screw fixings which are arranged regularly on the circumference of the collar 29.

Removing the cylinder arrangement 200 according to FIG. 2 from the printing unit is carried out as follows: following the detachment of the connection between frame part 11 and fixing element 13, for example by loosening screw connections, the fixing element 13 can be removed from the printing unit, passing over the cylinder journal 22 in the axial direction. At the same time, the supporting body 1 is fixed in its position at the opposite end in the printing unit, so that the orientation of the axis of rotation 8 of the supporting body 1 essentially remains unchanged. Then, by loosening the slotted nut 18, the clamping action of the deformable sleeve 24.1 of clamping device 9 can be canceled; the slotted nut 18 is moved outward, the pressure element 24 is relieved of load and the sleeve 24.1 previously deformed by the pressure element 24 is expanded. Following the expansion of the deformable sleeve 24.1 as a result of relieving the load on the pressure element 24 after the slotted nut 18 has been loosened, the sleeve-like portion 25 on the supporting body 1 can be detached. On the other side, following the removal of the fixing element 13 from the frame side 11, the cylinder arrangement according to FIG. 2, including the supporting body 1, axially fixed centering flange 2 and detachably positioned sleeve-like portion 25 of centering flange 5 with the cylinder sleeve 3 accommodated on its centering faces, can be removed in toto from the printing unit. Then, the actions of loosening the slotted nut 18 and removing the sleeve-like portion 25 from the supporting body 1, just described, can be carried out. Following the removal of the sleeve-like portion 25 from the circumference of the seating face 1*a* of the supporting body 1, the cylinder sleeve 3 having the worn functional layer 23 can simply be removed and replaced by a prepared functional layer, having photoelectric properties, for example, or replaced by a new cylinder sleeve which has a still unused functional layer 23 with photoelectric properties. Parts which are subject to only limited wear, such as the centering flanges 2 and 5 and the supporting body 1, can perfectly well be reused in the proposed cylinder arrangement of FIG. 2.

As a result of the centering faces 6, 7, configured as chamfers on the centering flanges 2 and 5, which have a mutually opposite chamfer, it is possible to exert an influence on the axial position of the functional layer 23 formed on the cylinder sleeve 3. In addition, by the centering flange 5 which can be positioned in the axial direction relative to the supporting body 1, an eccentricity of the functional layer 23 relative to the axis of rotation 8 of the supporting body 1 that accommodates the centering flanges 2 and 5 can be set.

The solution proposed according to the invention permits, in a simple way, the cost-effective replacement of a worn or highly stressed functional layer 23, which can be applied, for example, to a cylinder 3 made of aluminum or another material—a plastic material would also be conceivable. The degree of coverage of the chamfers formed on the cylinder sleeve 3 and complementary to the centering faces 6, 7 of the centering flanges 2 and 5 can also be less than 100% and, within the context of mounting the cylinder arrangement according to FIG. 2, can be preset when positioning the cylinder sleeve 3 on the centering faces 6, 7 of the centering flanges 2, or 5. Depending on the shape of the chamfer of the centering faces 6, 7 on the circumferential faces of the ends of the centering flanges 2 and 5, exerting a limited influence on the surface development of the cylinder arrangement according to FIG. 2 is possible.

It should not pass without mention that, with the arrangement illustrated in FIG. 2, it is possible to replace the cylinder sleeve 3 that accommodates the functional layer 23 both within a printing unit and outside one. After the frame side 11 has been exposed, by removing the fixing element 13 from the frame side 11 and the loosening of the slotted nut 18 (carried out in the printing unit), the centering flange 5 can be removed in the axial direction through the resulting opening in the frame side 11 even with the supporting body 1 remaining in the printing unit. The cylinder sleeve 3 that accommodates the functional layer 23 is then simply drawn laterally out of the printing unit through the opening which is formed as a result of the removal of the fixing element 13. A supporting body 1 that is supported in a suitable way can remain in the bearing at the pair of bearings 15 on the frame side 10, as can the centering flange 2 fixed axially and accommodated on its circumferential face.

The invention has been described in detail with particular reference to certain preferred embodiments thereof, but it will be understood that variations and modifications can be effected within the spirit and scope of the invention.

PARTS LIST

1 Supporting body
1*a*, 1*b* Seating faces
2 Centering flange
3 Cylinder sleeve
4 Pressure element
5 Centering flange
6 Centering face
7 Complementary centering face
8 Axis of rotation
9 Clamping device
10 Frame part
11 Frame part
12 Supporting bearing
13 Fixing element
14 Securing ring
15 Bearing
16 Bearing seat
17 Journal
18 Slotted nut
19 Slotted—nut thread
20 Pair of bearings
21 Seating face
22 Journal
23 Functional surface
24 Pressure element
24.1 Deformable sleeve
25 Sleeve-like portion of Centering flange
27 Bore
28 Bore wall
29 Collar on the fixing element

What is claimed is:

1. A replaceable cylinder element for a printing unit having at least one frame wall, said cylinder element comprising:

a cylindrical sleeve including centering sections located at the ends thereof, a functional layer accommodated on said sleeve, a supporting body adapted to pass through said cylindrical sleeve, two end members, having centering faces respectively complementary to said centering sections of said cylindrical sleeve, said end members being attached on said supporting body for supporting said cylindrical sleeve in a centered relation to an axis of said cylindrical sleeve by said centering faces cooperating with said complementary centering sections of said cylindrical sleeve, at least one of said end members being detachable with respect to said supporting body, and a bearing element, on which said supporting body is mounted in a frame wall of the printing unit, accommodated on said detachable one of said end members.

2. The replaceable cylinder element for a printing unit according to claim 1, wherein said centering sections on said sleeve and said centering faces at said end members are formed as chamfers.

3. The replaceable cylinder element for a printing unit according to claim 2, wherein one of said end members is positioned axially on the supporting body relative to the other of said end members.

4. The replaceable cylinder element for a printing unit according to claim 1, further including a clamping device located on said body adjacent to one of said end members, said clamping device (9) including a pressure element that can be prestressed axially, and an expandable member which is selectively deformed radially via said pressure element when prestressed axially to clamp said one end member to said supporting body.

5. The replaceable cylinder element for a printing unit according to claim 4, wherein said one end member which is clamped to said supporting body includes a sleeve that engages over said supporting body and said clamping device.

* * * * *